US005711622A

United States Patent [19]

Bringhurst et al.

[11] Patent Number: 5,711,622

[45] Date of Patent: Jan. 27, 1998

[54] PRINTER ELEMENT

[75] Inventors: Edward D. Bringhurst, Federal Way; David G. Starr, Renton, both of Wash.

[73] Assignee: Tally Printer Corporation, Kent, Wash.

[21] Appl. No.: 827,673

[22] Filed: Apr. 10, 1997

Related U.S. Application Data

[63] Continuation of Ser. No. 602,333, Feb. 16, 1996, abandoned.

[51] Int. Cl.[6] ..... B41J 2/235

[52] U.S. Cl. ..... 400/124.29; 400/124.32; 400/124.31

[58] Field of Search ..... 400/124.29, 124.28, 400/124.11, 124.3, 124.31, 124.32; 346/141, 142, 139 C

[56] References Cited

U.S. PATENT DOCUMENTS

| | | | |
|---|---|---|---|
| 3,217,640 | 11/1965 | Bradshaw . | |
| 3,850,278 | 11/1974 | Mihm et al. . | |
| 4,143,979 | 3/1979 | Boyd . | |
| 4,242,004 | 12/1980 | Adler | 400/124.31 |
| 4,256,948 | 3/1981 | Wolf et al. . | |
| 4,268,180 | 5/1981 | Honma | 400/124.3 |
| 4,269,090 | 5/1981 | Ingber et al. | 101/3.1 |
| 4,304,495 | 12/1981 | Wada et al. | 400/124.32 |
| 4,307,966 | 12/1981 | Spencer et al. | 400/124.31 |
| 4,348,120 | 9/1982 | Isobe et al. . | |
| 4,393,771 | 7/1983 | Tatsumi . | |
| 4,420,266 | 12/1983 | Kolm et al. . | |
| 4,428,285 | 1/1984 | Cole et al. . | |
| 4,457,636 | 7/1984 | Nusser . | |
| 4,524,259 | 6/1985 | Wolf et al. | 400/124.31 |
| 4,544,288 | 10/1985 | Suzuki et al. | 400/124.31 |
| 4,974,975 | 12/1990 | Andou et al. . | |
| 5,118,210 | 6/1992 | Kobayashi et al. . | |
| 5,169,246 | 12/1992 | Bernardis et al. . | |
| 5,261,753 | 11/1993 | Endoh et al. . | |
| 5,344,243 | 9/1994 | Sawa et al. . | |
| 5,361,693 | 11/1994 | Farb et al. . | |

FOREIGN PATENT DOCUMENTS

| | | | |
|---|---|---|---|
| 227391 | 9/1985 | Germany | 400/124 WD |

*Primary Examiner*—Edgar S. Burr
*Assistant Examiner*—Daniel J. Colilla
*Attorney, Agent, or Firm*—Christensen, O'Connor, Johnson & Kindness PLLC

[57] ABSTRACT

An integrally-formed print element for providing finer dots than previously possible with an impact printer. The dots produced permit the printing of Chinese, Amharic, Devanagari, and like characters, in sizes as small as standard newsprint, and print in books and periodicals, without significant distortion of the characters. The print element has an axis of symmetry and includes in order a cylindrical base with a longitudinal axis corresponding to the axis of symmetry of the print element; a frusto-conical-shaped impact element support with its largest diameter end extending from one end of the cylindrical base; and a cylindrical impact element located on and extending integrally from the other end of the frusto-conical-shaped support. The overall size of the print element is preferably such that it is attachable to standard impact printer hammer tips.

26 Claims, 4 Drawing Sheets

Fig. 3C
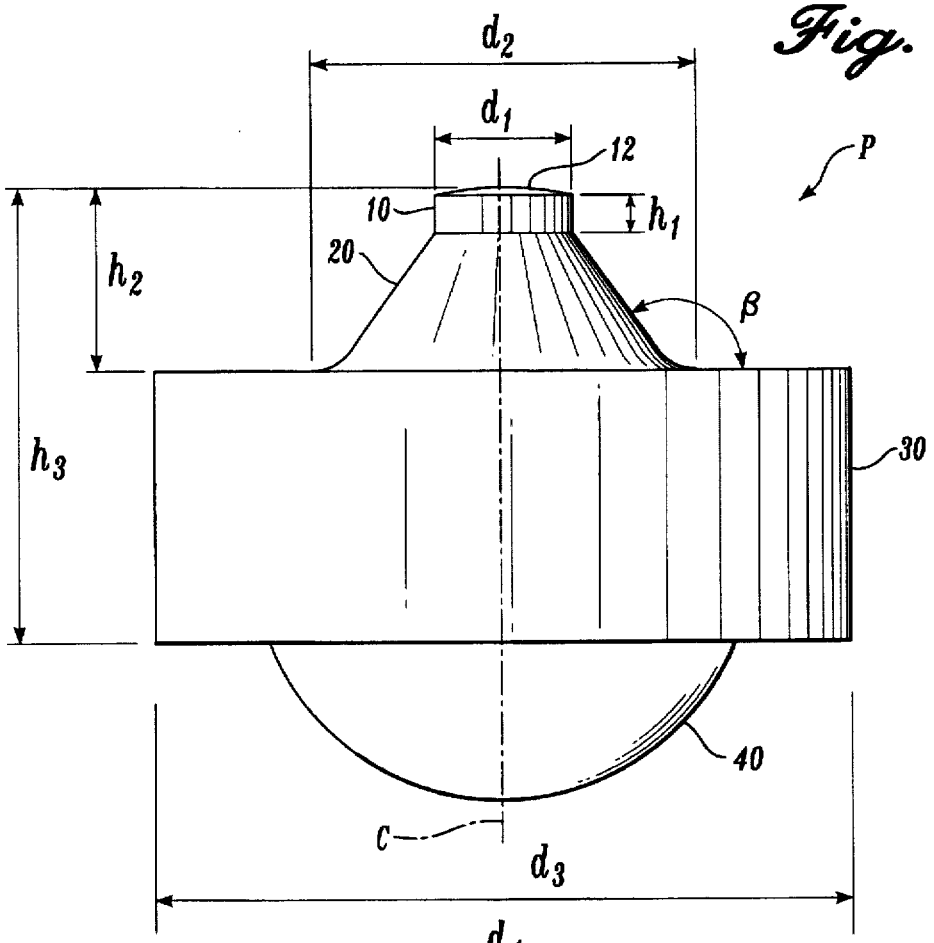
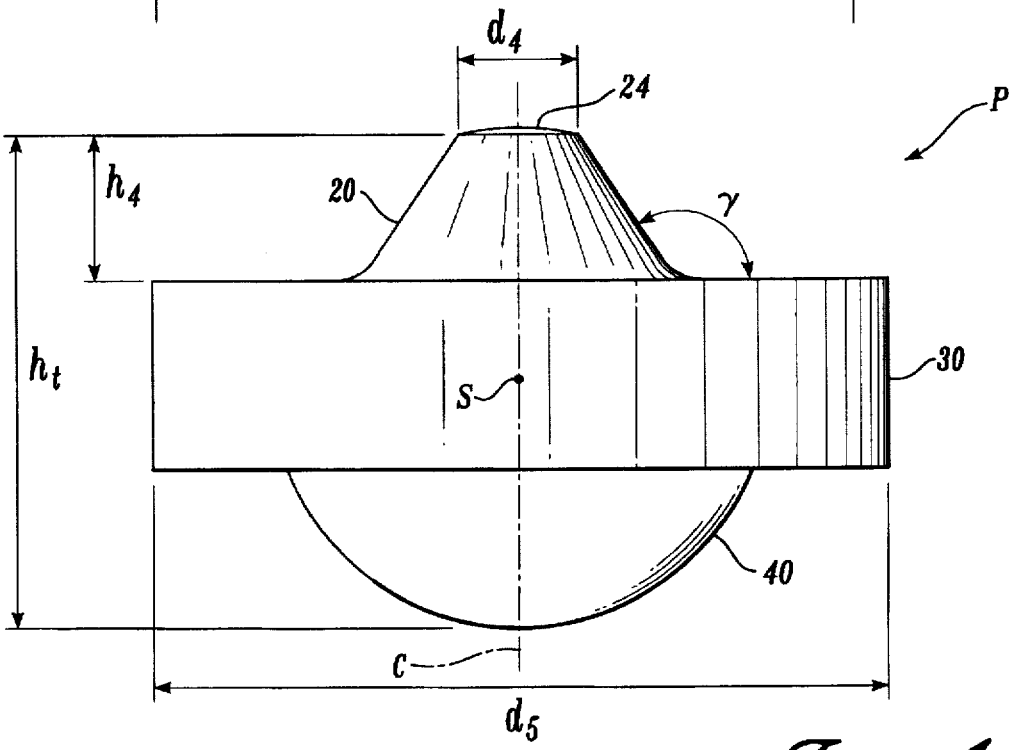
Fig. 4

PRINTER ELEMENT

This application is a continuation application of application Ser. No. 08/602,333, filed on Feb. 16, 1996, now abandoned.

FIELD OF THE INVENTION

The invention relates to impact printers, typically used in relatively high-speed printing operations. More particularly, the invention provides a print element for use in impact printers that produces a smaller dot size to allow the precise forming of characters in languages like Chinese, Amharic, and Devanagari, in type sizes that are commonly used.

BACKGROUND OF THE INVENTION

Dot matrix line impact printers have achieved large scale use in western countries that use the traditional western alphabet. The printers art reliable and relatively inexpensive, as compared to band, chain or other formed character printers, and are also reliable. Importantly, as illustrated in FIG. 1, the printers operate by impacting an ink ribbon with a spherical-shaped print element 10' welded to the tip of a print hammer 12' to produce an ink dot on a paper on the other side of the ribbon. The dots can be formed into clearly defined characters in point sizes that provide for ease of reading, in the western alphabet. In particular, a character of 10 or 12 point size can be produced with relatively minimal distortion. As a consequence, the printers are used in a wide variety of intermediate and high speed applications.

Outside of the western word, indigenous languages are often printed in a non-western alphabet. For example, the Chinese, Amharic, Devanagari, or other alphabet may be used. While a Chinese alphabetic character may be printed in larger sizes, such as a 16 point (5.59×5.95 mm) size, with minimal distortion using a standard 0.032 inch diameter ball impact print element, smaller point size characters are progressively more distorted. For example, open spaces between strokes of the characters become filled with overlap ink so that the characters become unclear. In order to produce clear, relatively undistorted, images of characters in these alphabets of smaller size, for example 11 point, the dot used to produce the characters must be significantly reduced in size. There is a need for an impact printer that has a print element able to produce a smaller dot that will enable printing of substantially undistorted characters in smaller point sizes at high speed.

While it may appear to be intuitively obvious to produce a smaller dot by making smaller spherical print elements, tests have shown that a smaller spherical element does not necessarily produce a correspondingly smaller dot. Thus, printers have turned to alternative means for producing a small dot. It is known that a cylindrical wire of predetermined cross section will produce a dot of a magnitude corresponding to the size of the cross-sectional area. Such a print element is in use in special services, such as described above. The pit element, illustrated in FIG. 2, generally include a boot 20' into which is welded a wire 22' that has a cross section corresponding to the desired diameter of a dot to be produced. These wire-and-boot assemblies are expensive, generally costing between 300 and 500 times as much as the more commonly used spherical-shaped print elements.

There is a need for a print element for an impact printer to produce a printed dot of reduced size so that characters in Chinese, Amharic, Devanagari, and like alphabets that have a flowing script or complex-shaped characters, can be produced with minimal distortion or blotting over dear spaces in the characters in commonly used point sizes, such as the sizes used for newsprint, books, and periodicals. Moreover, the print element should be reliable and not subject to failure, so that its useful life. approximates that of existing spherical-shaped print elements. Finally, the print element preferably should be reproducible at a commercially useful cost, and should not, like the wire-and-boot attempt, be 300 to 500 times as costly to make as the standard spherical-shaped impact printer print element.

SUMMARY OF THE INVENTION

The invention provides a print element that is integrally formed of a hard, impact-resistant material, such as tungsten carbide, and that has a life approximating that of the standard spherical-shaped impact printer pit element. The print element of the invention is able to provide a dot of from about 0.008 inches to about 0.010 inches in diameter so that it is eminently useful for forming characters in languages like Chinese, Amharic, Devanagari, Japanese, and the like, in point sizes smaller than 16 point that are commonly useful in standard reading material, such as newspapers, periodicals, and books, with minimal distortion of the characters, when compared with characters formed from standard 0.032 diameter spherical ball print elements.

The invention provides an integrally-formed print element that includes a cylindrical base having a longitudinal axis of symmetry. A frusto-conical-shaped print element support, with a central axis coincident with the axis of the base, extends integrally from one end of the base. The portion of the support that has a largest diameter intersects the one end of the base. A cylindrical impact element, also having a longitudinal axis of symmetry that is coincident with the axes of the base and the frusto-conical-shaped support, extends integrally from the other end of the frusto-conical support so that the diameter of the cylindrical impact element is equal to the smallest diameter at the end of the frusto-conical-shaped support. The impact element has a print face that is curved convexly outward for striking an inked ribbon.

In another embodiment, there is no discernible cylindrical impact element at the smaller diameter end of the support. Instead, the tip of the frusto-conical support is rounded, in an outward biconvex curvature, to form the print face.

Optionally, in order to facilitate attachment of the print element to the tip of a print hammer, a rounded-shaped print element attachment portion extends from an opposite end of the cylindrical base. This attachment portion is shaped like a segment of a sphere that has its center along the longitudinal axis of the cylindrical base. The rounded spherical segment acts as a projection that assists in resistance welding it to the hammer tip. The embodiments of the invention that do not have such a rounded attachment portion are also easily attachable to standard print hammer tips.

In order to ensure that the print element of the invention has a long commercial life, the print element is preferably made from a hard, impact and wear-resistant material, such as tungsten carbide. When tungsten carbide, or another hard material is used, then it is preferred to form the print element in a metal injection molding process so that the element is integrally formed as a unitary construct. Moreover, this process facilitates the shaping of a smooth print element face or tip and allows adjustment of the diameter of the tip so that a desired dot size can be produced. In accordance with the invention, the diameter of the print element tip ranges from about 0.006 inches to about 0.016 inches, preferably about 0.008 inches. Such a print element, when used in an impact printer, produces a dot size smaller than that which could be produced from a spherical print element having the same diameter.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein:

FIG. 3C is another embodiment of the print element of the invention, in side view;

FIG. 4 is a side view of an alternative embodiment of a print element according to the invention;

DETAILED DESCRIPTION OF THE PREFERRED EMBODIMENT

The pit element of the invention produces a smaller dot so that impact printers using such an element are able to print Chinese, Amharic, Devanagari, and like characters in smaller than 16 point size with minimal distortion. In particular, for Chinese characters readability at 11 point size using the print element of the invention is comparable with readability of 16 point sized characters printed by a standard 0.032 inch diameter ball print element.

Figure 1:
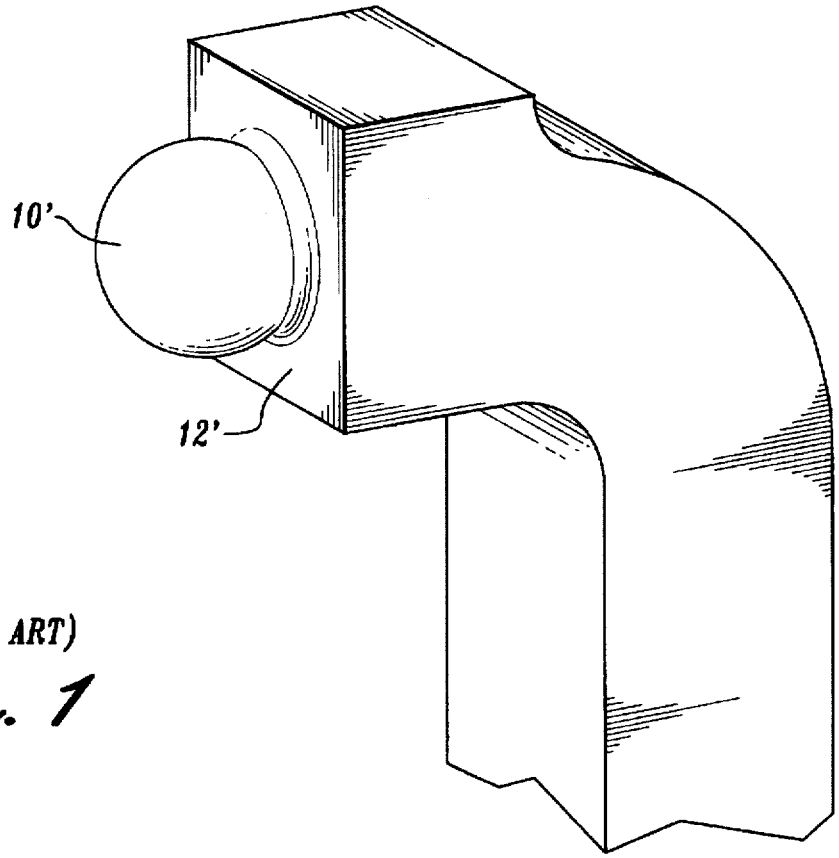
(PRIOR ART) Fig. 1
FIG. 1 is a schematic perspective view showing a prior art spherical print element attached to the tip of a print hammer.
Figure 2:
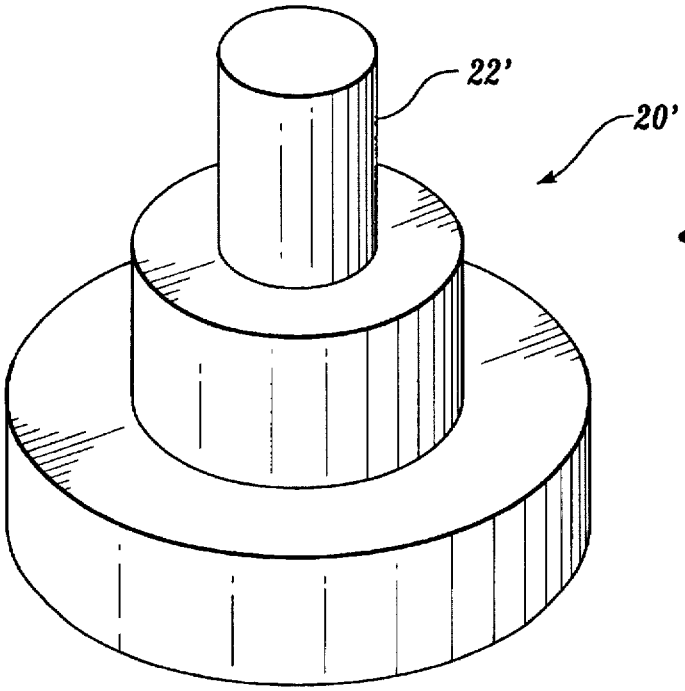
(PRIOR ART) Fig. 2
FIG. 2 is a perspective view of a print element of the wire and boot-type used in the prior art.
Figure 3A:
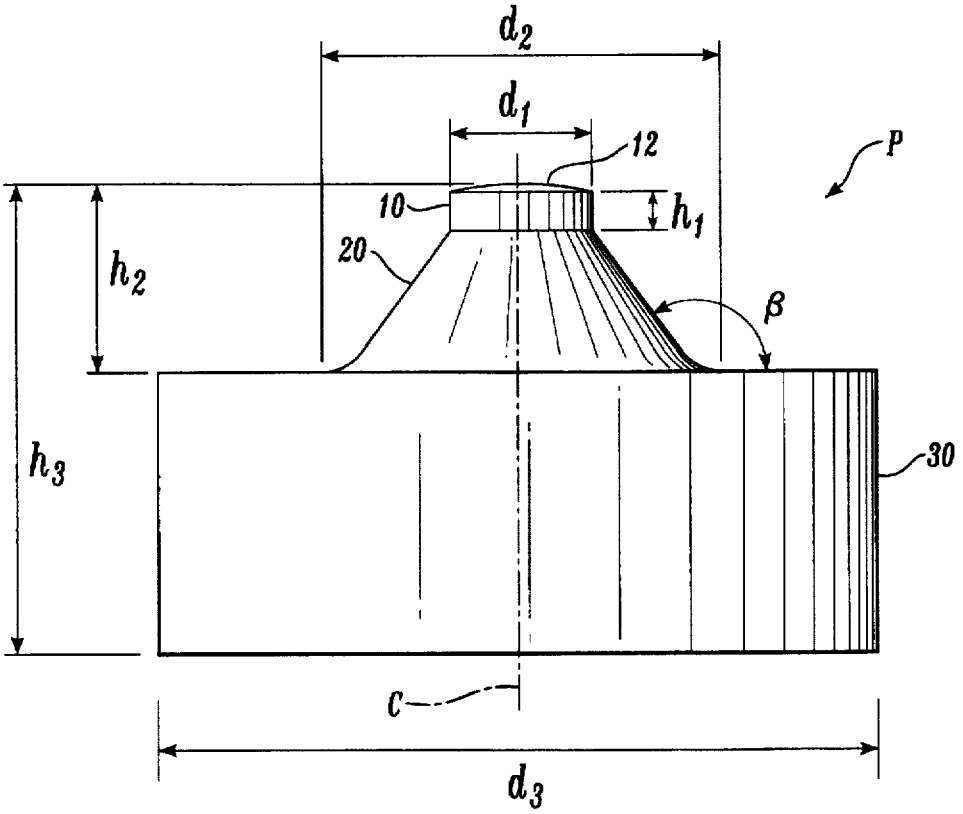
FIG. 3A is a side view of an embodiment of the print element of the invention.
Figure 3B:
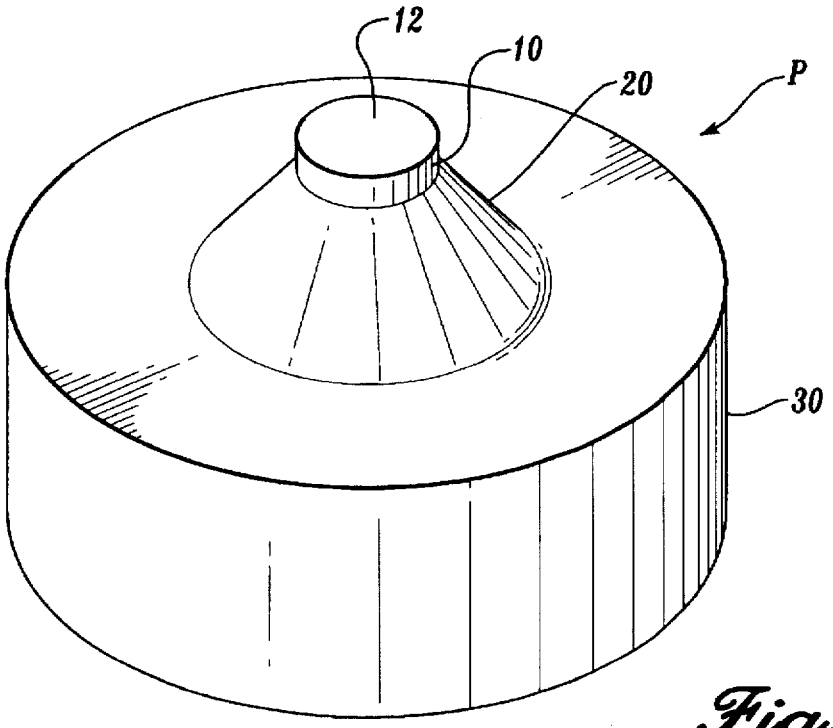
FIG. 3B is a perspective view diagrammatically depicting the print element of FIG. 3A.

The print element of the invention may be better understood with reference to illustrative examples of preferred embodiments shown in the FIGURES. FIGS. 3A and 3B show a preferred embodiment of the print element P that is symmetrical about a central axis C. Preferably, the print element P is integrally formed as a unitary construct and symmetrical about a central axis of symmetry. The print element has a cylindrical impact element 10 at one end, a cylindrical base 30 at the other end, and a frusto-conical-shaped impact element support 20 intermediate the impact element 10 and the base 30, to support the impact element 10 on the base 30. As integrally formed, the longitudinal axes of symmetry of the cylindrical impact element 10, the frusto-conical support 20, and the cylindrical base 30, are coincident with the axis of symmetry C of the print element P.

The cylindrical impact element 10 preferably has a diameter $d_1$ in the range from about 0.006 to about 0.016, preferably about 0.008 inches. Moreover, the upper surface or prim face 12' of the impact element 10 preferably has a convex curvature, the convex curvature corresponding to a portion of a surface of a sphere having a diameter from about 0.031 to about 0.033, preferably about 0.0320 inches. While the height $h_1$ of the impact element 10 is not critical, it is preferred that the element be relatively short, preferably about 0.002 to about 0.005, most preferably about 0.003 inches. An impact element of restricted height is preferred to minimize stress concentration at the interface between the impact element 10 and the support 20 to minimize or reduce the risk of fracture at the interface. The perimeter of the impact element at its upper circular edge is preferably rounded by a small radius curve to remove sharp edges that may damage the inked ribbon after continuous impact.

The smallest diameter of the frusto-conical support is at the point where it integrally joins with the impact element 10. Thus, the smallest diameter of the support is $d_1$. The support flares outward symmetrically to its base, the base being located $h_2$ from about 0.010 to about 0.014 inches from the outermost extremity of the print face 12, preferably about 0.012 inches. The sloping sides of the support 20 are at an angle β to the horizontal, preferably β is from about 100 to about 150 degrees, more preferably about 125° . The angle β should be as large as possible, but not greater than about 160 degrees. A large β will assist in dissipating force of impact from the impact element 10, through the support and to the base 30. Thus, it is preferred that the support have a wide base 22 which can only be obtained through a large angle β. The largest diameter $d_2$ of the support 20 is preferably in the range 0.017 to 0.022 inches. The support 20 is smoothly integrated into the base 30 and preferably has a small radius curvature (radius about 0.002 to 0.004 inches) at the point of intersection with the base to prevent an abrupt transition line.

The cylindrical base 30 is integrally formed with the support 20 and the impact element 10. Preferably, the base has a diameter $d_3$ that is larger than the diameter $d_2$ of the base 22 of support 20, and larger than the diameter $d_1$ of the impact element 10. This diameter $d_3$ is preferably in the range from about 0.040 to about 0.050 inches. Preferably, the overall height $h_3$ of the print element P, as measured from the outermost point of the print face 12 to the undersurface of the base 30, is from about 0.025 to about 0.080 inches, more preferably about 0.035 inches. This latter dimension corresponds to the diameter of standard spherical-shaped print elements currently used in impact printers. Therefore, the print element P of the invention is sized for ready attachment to the tips of existing impact printer hammers.

FIG. 3C illustrates another embodiment of the print element of the invention. This element is similar to that shown in FIGS. 3A and B, and described above, but it has a hemispherical attachment portion 40 affixed below the cylindrical base 30. This attachment portion has a radial axis of symmetry that coincides with the central longitudinal axis C of the base 30 and the print element. Preferably, the attachment portion is a hemisphere curving outward from the base and has a center S located at about the mid-point of the base 30, along the central axis C. Preferably, the attachment portion 40 has a diameter of about 0.033 to about 0.031, most preferably 0.032 inches for ease of attachment to a standard hammer tip normally receiving a 0.032 inch diameter standard ball. Preferably, the overall height $h_3$ of the print element P is in the range 0.031 to 0.032, most preferably 0.032 inches, for ease of use with a standard impact printer hammer bank.

FIG. 4 illustrates a further alternative embodiment of the print element of the invention. In this embodiment, a rounded-shaped attachment portion 40 is integrally formed with the print element and extends from the undersurface of the base 30. Moreover, instead of a print element face 12 supported on an impact element 10 as in the embodiment of FIGS. 3A and 3B, the print element face 24 is integrated directly into a tip of the frusto-conical-shaped support 20. Once again, the print element P is symmetrical about a center of symmetry C. The axis of symmetry of the frusto-conical support, the central longitudinal axis of the cylindrical base 30, and a radial axis of symmetry of the spherical attachment portion 40, all coincide with the axis of symmetry C of the print element P. Also, as in the embodiment of FIGS. 3A–3C, it is preferred that the upper circumference of the impact face 24 have a small radius curve to avoid sharp edges that may damage the inked ribbon.

The frusto-conical-shaped support 20 has an outwardly-extending tip of smallest diameter $d_4$ of from about 0.006 to about 0.016 inches, preferably about 0.008 inches. A print face 24 extends across this smallest diameter tip of the support and has an outwardly convex shape, the convex surface being a portion of a surface of a sphere having a diameter from about 0.031 to about 0.033 inches, preferably 0.032 inches. The sides of the support 20 slope downward symmetrically away from the axis of symmetry C toward the cylindrical base 30, at an angle $\gamma$ to the horizontal. Preferably, $\gamma$ is from about 100 to about 150 degrees, more preferably about 110 to about 130 degrees. The height $h_4$ of the support 20, from the highest point of the print face 24, to the base of the support, is from about 0.008 to about 0.020, preferably about 0.01 inches. The base of the support 20 smoothly intersects with, and is integral with one end of the cylindrical base 30. Preferably, the intersection has a small, smoothly rounded radius curve (radius about 0.002 to 0.004 inches) to avoid an abrupt transition.

The cylindrical base 30 has a diameter $d_5$ of from about 0.030 to about 0.060 inches, preferably about 0.046 inches. This diameter is significantly greater than the diameter of the support at its widest point. Such a design is preferred to allow dissipation of impact forces from the support 20 to the base 30.

A rounded-shaped attachment portion 40 extends from the other end of the cylindrical base portion 30 so that the rounded portion 40 may readily be fitted into, and resistance welded by projection welding to the tip of a print hammer. The overall height $h_r$ of the print element P is preferably from about 0.031 to about 0.033, more preferably about 0.032 inches so that a standard print hammer may be used in conjunction with the print element of the invention. To further facilitate this, it is preferred that the rounded portion 40 comprise a segment of a sphere having a diameter of about 0.032 inches. As shown, the rounded portion lies directly on the locus of circumference of a circle that has a center S that is located on the longitudinal axis of symmetry of the cylindrical base 30, and on the axis of symmetry C of the print element P. Since the rounded portion 40 is less than a hemisphere, the center of the circle S is preferably located within the base 30, preferably at the mid-point of the height of the base 30 and on the central axis C, as shown.

Figure 5A:
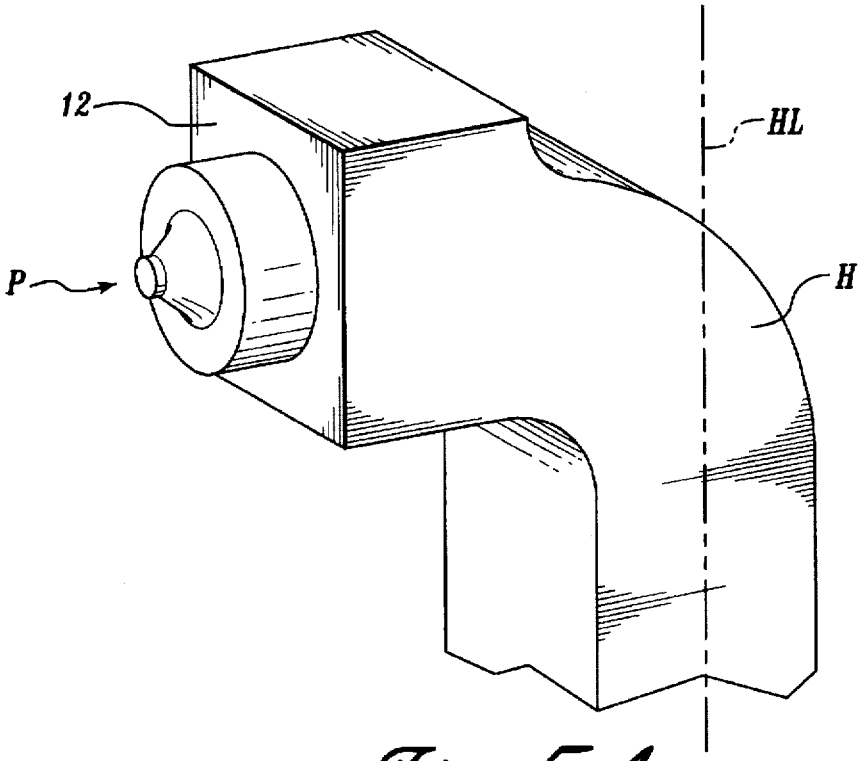
FIG. 5A is a perspective view of an embodiment of a print element according to the invention attached to the tip of a line printer hammer.
Figure 5B:
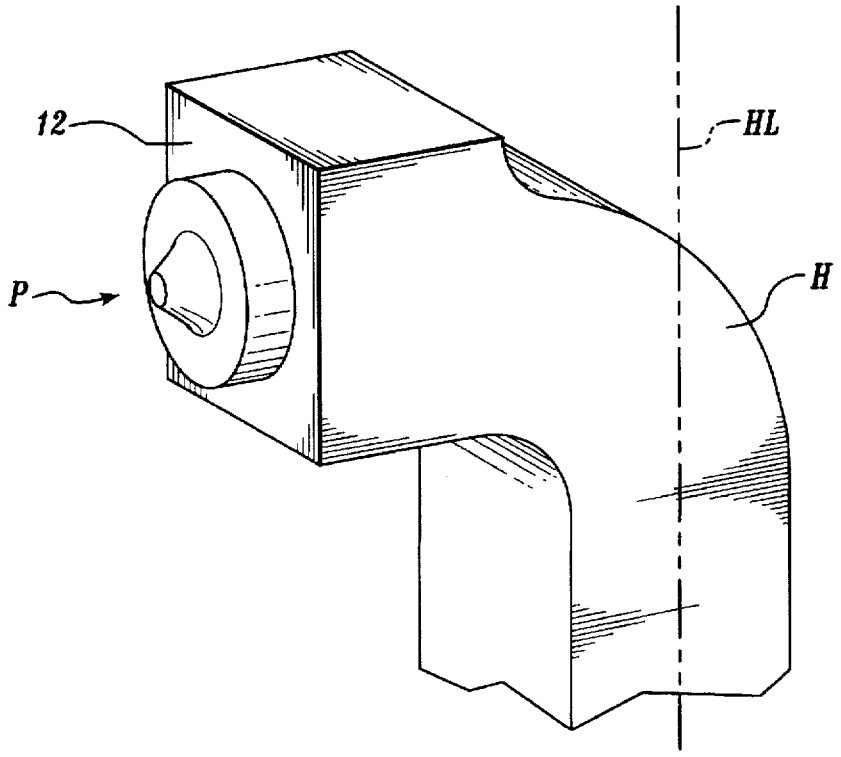
FIG. 5B is a perspective view of an alternative embodiment of a print element in accordance with the invention, attached to the tip of a line printer hammer.

FIG. 5A shows an embodiment of the invention, wherein a print element P is attached to the tip 12 of a print element hammer H. As shown, the hammer H has a longitudinal axis HL, and the print element is mounted to the tip 12 of the hammer such that its axis of symmetry C is at an angle to the longitudinal axis HL of the hammer. Similarly, FIG. 5B shows an alternative embodiment of the print element of the invention attached to the tip of a line printer hammer.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A combination print hammer and print element suitable for use in a dot matrix printer to print dots on a print-receiving substrate, said combination comprising:

(a) an elongate print hammer having one end designed for movement toward and away from a print-receiving substrate; and (b) a print element affixed to the side of the end of said elongate print hammer that is designed for movement toward and away from a print-receiving substrate, said print element being injection molded of high-impact resistant metal so as to form a unitary construct, said unitary construct including a plurality of sections located along an axis of symmetry that lies generally orthogonal to the longitudinal axis of said elongate print hammer, said plurality of sections comprising:

(i) a cylindrical base, one end of said cylindrical base being affixed to said side of the end of said elongate print hammer that is designed for movement toward and away from a print-receiving substrate, the height of said cylindrical base relative to said side of the end of said elongate print hammer that is designed for movement toward and away from a print-receiving substrate being less than the diameter of said cylindrical base, the longitudinal axis of said cylindrical base lying along said axis of symmetry;

(ii) an impact element support, said impact element support having a frusto-conical shape, the longitudinal axis of said frusto-conically shaped impact element support lying along said axis of symmetry, the large diameter end of said frusto-conically shaped impact element support being less than the diameter of said cylindrical base, the large diameter end of said frusto-conically shaped impact element support being unitarily formed with the end of said cylindrical base opposite to the end affixed to said elongate print hammer such that the longitudinal axis of said cylindrical base and the longitudinal axis of said frusto-conical shape are coaxial; and (iii) an impact element unitarily formed with the small diameter end of said frusto-conically shaped impact element support, the face of said impact element opposite said small diameter end of said impact element support having a convex shape, the distance between the outer end of said face of said impact element and the small diameter end of said frusto-conically shaped impact element support being substantially less than the diameter of the small end of said frusto-conically shaped support, the overall height of said print element relative to said side of the end of said elongate print hammer that is designed for movement toward and away from a print-receiving substrate being less than twice the diameter of said cylindrical base of said print element.

2. The combination claimed in claim 1, wherein said high impact resistance metal is tungsten carbide.

3. The combination claimed in claim 2, wherein the diameter of the small diameter end of said frusto-conically shaped impact element support and, thus, the diameter of said impact element lies in the range from about 0.006 inches to about 0.016 inches.

4. The combination claimed in claim 3, wherein the convex shape of said face of said impact element is in the form of a portion of a surface of a sphere having a diameter that lies in the range from about 0.031 inches to about 0.033 inches.

5. The combination claimed in claim 4, wherein the diameter of the large diameter end of said frusto-conically shaped impact element support lies in the range from about 0.017 inches to about 0.022 inches.

6. The combination claimed in claim 5, wherein the diameter of said cylindrical base lies in the range from about 0.040 inches to about 0.050 inches.

7. The combination claimed in claim 1, wherein the end of said cylindrical base of the print element that is affixed to said side of the end of said elongate print hammer that is designed for movement toward and away from a print-receiving substrate includes a print element attachment protrusion, said print element attachment protrusion having the shape of a rounded segment of a sphere, said rounded segment of a sphere lying along said symmetrical axis.

8. The combination claimed in claim 7, wherein said high-impact resistance metal is tungsten carbide.

9. The combination claimed in claim 8, wherein the diameter of the small diameter end of said frusto-conically shaped impact element support and, thus, the diameter of said impact element lies in the range from about 0.006 inches to about 0.016 inches.

10. The combination claimed in claim 9, wherein the convex shape of said face of said impact element is in the form of a portion of a surface of a sphere having a diameter that lies in the range from about 0.031 inches to about 0.033 inches.

11. The combination claimed in claim 10, wherein the diameter of the large diameter end of said frusto-conically shaped impact element support lies in the range from about 0.017 inches to about 0.022 inches.

12. The combination claimed in claim 11, wherein the diameter of said cylindrical base lies in the range from about 0.040 inches to about 0.050 inches.

13. The combination claimed in claim 12, wherein the diameter of the rounded segment of the sphere that forms said print element attachment protrusion has a diameter lying in the range from about 0.30 inches to about 0.033 inches.

14. The combination claimed in claim 1, wherein said impact element includes a cylindrical section that is equal in diameter to the diameter of the small diameter end of said frusto-conically shaped impact element support, said cylindrical section lying between the face of said impact element and the small diameter end of said frusto-conically shaped impact element support.

15. The combination claimed in claim 14, wherein said high-impact resistance metal is tungsten carbide.

16. The combination claimed in claim 14, wherein the diameter of the small diameter end of said frusto-conically shaped impact element support and, thus, the diameter of said impact element lies in the range from about 0.006 inches to about 0.016 inches.

17. The combination claimed in claim 14, wherein the convex shape of said face of said impact element is in the form of a portion of a surface of a sphere having a diameter that lies in the range from about 0.031 inches to about 0.033 inches.

18. The combination claimed in claim 14, wherein the diameter of the large diameter end of said frusto-conically shaped impact element support lies in the range from about 0.017 inches to about 0.022 inches.

19. The combination claimed in claim 14, wherein the diameter of said cylindrical base lies in the range from about 0.040 inches to about 0.050 inches.

20. The combination claimed in claim 14, wherein the end of said cylindrical base of the print element that is affixed to said side of the end of said elongate print hammer that is designed for movement toward and away from a print-receiving substrate includes a print element attachment protrusion, said print element attachment protrusion having the shape of a rounded segment of a sphere, said rounded segment of a sphere lying along said symmetrical axis.

21. The combination claimed in claim 20, wherein said high-impact resistance metal is tungsten carbide.

22. The combination claimed in claim 21, wherein the diameter of the small diameter end of said frusto-conically shaped impact element support and, thus, the diameter of said impact element lies in the range from about 0.006 inches to about 0.016 inches.

23. The combination claimed in claim 22, wherein the convex shape of said face of said impact element is in the form of a portion of a surface of a sphere having a diameter that lies in the range from about 0.031 inches to about 0.033 inches.

24. The combination claimed in claim 23, wherein the diameter of the large diameter end of said frusto-conically shaped impact element support lies in the range from about 0.017 inches to about 0.022 inches.

25. The combination claimed in claim 24, wherein the diameter of said cylindrical base lies in the range of from about 0.040 inches to about 0.050 inches.

26. The combination claimed in claim 25, wherein the diameter of the rounded segment of the sphere that forms said print element attachment protrusion has a diameter lying in the range from about 0.30 inches to about 0.033 inches.

* * * * *